US007310565B2

(12) United States Patent
Vergote et al.

(10) Patent No.: US 7,310,565 B2
(45) Date of Patent: Dec. 18, 2007

(54) METHOD FOR OPTIMIZING A TEXTILE PRODUCTION PROCESS AND DEVICES APPLYING THIS METHOD

(75) Inventors: Filip Vergote, Menen (BE); Antony Rouzere, Passendale (BE); Jozef Peeters, Ieper (BE)

(73) Assignee: Picanol N.V., Naamloze Vennootschap, Ieper (BE)

( * ) Notice: Subject to any disclaimer, the term of this patent is extended or adjusted under 35 U.S.C. 154(b) by 0 days.

(21) Appl. No.: 10/474,198

(22) PCT Filed: Apr. 18, 2002

(86) PCT No.: PCT/BE02/00057

§ 371 (c)(1),
(2), (4) Date: Oct. 17, 2003

(87) PCT Pub. No.: WO02/086214

PCT Pub. Date: Oct. 31, 2002

(65) Prior Publication Data

US 2004/0133297 A1 Jul. 8, 2004

(30) Foreign Application Priority Data

Apr. 20, 2001 (BE) ..... 2001/0274

(51) Int. Cl.
*G06F 19/00* (2006.01)

(52) U.S. Cl. ..... 700/140; 139/318

(58) Field of Classification Search ..... 700/130, 700/131, 140, 139; 139/318, 319
See application file for complete search history.

(56) References Cited

U.S. PATENT DOCUMENTS

| | | | | |
|---|---|---|---|---|
| 4,582,095 | A * | 4/1986 | Kronholm | 139/1 R |
| 4,643,230 | A | 2/1987 | Aemmer et al. | |
| 4,702,283 | A | 10/1987 | Shaw | |
| 4,791,481 | A * | 12/1988 | Verdiere et al. | 348/88 |
| 4,953,400 | A * | 9/1990 | Bossuyt | 139/1 B |
| 5,200,904 | A * | 4/1993 | Tottman | 700/131 |
| 5,224,047 | A | 6/1993 | Kitagawa et al. | |
| 5,388,618 | A | 2/1995 | Decock | |
| 5,475,887 | A | 12/1995 | Moussalli | |
| 6,006,791 | A | 12/1999 | Herrlein | |
| 6,102,079 | A * | 8/2000 | Croucher et al. | 139/1 R |
| 6,404,910 | B1 * | 6/2002 | Ungpiyakul et al. | 382/141 |

FOREIGN PATENT DOCUMENTS

EP 0 495 984 A1 7/1992

(Continued)

OTHER PUBLICATIONS

Patent Abstracts of Japan, vol. 018, No. 367 (C-1223), Jul. 11, 1994 & JP 06 093538 A (Tsudakoma Corp.), Apr. 5, 1994 abstract; figure 1.

Patent Abstracts of Japan, vol. 1998, No. 14, Dec. 31, 1998 & JP 10 251942 A (Toyota Autom Loom Works Ltd.), Sep. 22, 1998 abstract; figures.

*Primary Examiner*—Danny Worrell
(74) *Attorney, Agent, or Firm*—Bacon & Thomas, PLLC

(57) ABSTRACT

Method for optimizing a textile production process, which consists in manufacturing a fabric (11) on a weaving machine (1), characterized in that characteristics of the fabric (11) and/or fabric-determining elements are visualized on a machine screen by means of at least one image.

21 Claims, 3 Drawing Sheets

FOREIGN PATENT DOCUMENTS

| | | |
|---|---|---|
| EP | 0 924 325 A1 | 6/1999 |
| FR | 2 785 625 | 5/2000 |
| JP | 10-251942 | 9/1998 |
| WO | 97/27471 | 7/1997 |
| WO | 99/34046 | 7/1999 |
| WO | 00/56964 | 9/2000 |

* cited by examiner

METHOD FOR OPTIMIZING A TEXTILE PRODUCTION PROCESS AND DEVICES APPLYING THIS METHOD

BACKGROUND

A. Field of the Invention

This invention relates to a method for optimizing a textile production process, as well as to devices applying this method.

B. Related Art

By the term textile production process, it is intended to mean all processes which are related to the production of textile products, where, in respect to products, weaving products specifically are meant and, more generally, other textile products may be included, such as products which are manufactured in a spinning mill. With respect to devices for textile production, weaving machines are intended, although more generally, other devices may be included, including peripherical devices for such devices.

It is known that with textile production processes, in particular with weaving processes, it is important that the continuity of a smooth operation is assured and, with a possible intervention of an operator or such, that the operation runs as smooth as possible. A problem with the known textile production processes consists in that it still is particularly difficult to guarantee such continuity and have interventions run smoothly. Thus, the invention aims at an optimalization which meets these requirements.

SUMMARY OF THE INVENTION

This optimalization is realized according to different aspects, which either can be mutually combined or not, which each solve a number of specific problems and/or offering advantages.

According to a first aspect, the invention provides for a method for optimizing a textile production process which comprises manufacturing a fabric on a weaving machine, wherein the fabric and/or the factors determining the fabric are visualized on a machine screen by means of at least one image.

Contrary to the embodiments already known, whereby at the machine information exclusively in the form of signs, a written text or codes is represented, which has as a disadvantage that the usage possibilities thereof are only very restricted, now, by visualizing, according to the invention, characteristics of the fabric and/or factors determining the fabric by means of an image or a series of images on the machine screen, the operator or such will view a realistic picture, as a result of which a direct visual control is made possible.

According to the invention, different visualizations can be performed. A number of preferred are:

According to a first possibility, the visualization comprises at least the representation of the fabric formed on the weaving machine or of a part thereof and/or of one or more fabric-determining elements. In this manner, the visualized part can be represented, for example, on a larger scale, as a result of which it becomes easier for the operator to control certain parts.

According to a second possibility, the visualization comprises at least the representation of the fabric to be formed or of a part thereof and/or of the appearance that one or more fabric-determining elements must have for forming a specific fabric. This offers the advantage that the operator of the weaving machine can perform a visual correlation between the fabric to be woven and/or the appearance that certain fabric-determining elements have to show, the image of which is shown on the machine screen, and the real fabric present on the weaving machine, the fabric-determining elements which are actually present on the weaving machine, respectively.

According to a third possibility, the visualization comprises a representation of, on one hand, an image according to said first possibility, more particularly an image of the real appearance, as well as, on the other hand, an image according to the second possibility, more particularly, an image which represents how the actual appearance really should be, this of course for the same fabric parts or the same fabric-determining elements. This offers the advantage that the operator of the weaving machine easily can perform a visual control, as the two represented images, of the condition as it really is, and of the theoretically desired condition, respectively, are directly represented next to each other. In this manner, an easy visual control is possible by comparing both images to each other, either visually by the operator, or automatically.

According to a fourth possibility, not only is a comparison between the two images performed, but also possible deviations, faults, respectively, are shown on the machine screen, possibly completed by comments. Hereby, also possible deviations can be illuminated or accentuated on the machine screen.

With the visualization, it is possible to form images of different items A number of preferred possibilities is described in the following:

According to a first possibility, a visualization is performed which is related to the actual fabric, in other words, a part of the actual fabric is shown on the machine screen, either by means of a photographic image or such of the theoretically formed fabric, or of the fabric as it really is, or of both.

This is particularly important for changing articles on weaving machines equipped with a Jacquard mechanism, for example, in order to verify whether the right colour is being woven, more particularly with patterns having several colour variants.

It is also important to control the fabric for usual faults by means of a comparison or visual control, as described in the above-mentioned four possibilities.

According to a second possibility, a visualization is provided in respect to the edge bindings, whereby this visualization is used for indicating whether a correct pattern, a correct threading, respectively, has been made, as this is highly important for a high-quality fabric.

According to a third possibility, a visualization is provided in respect to the warp threads and/or the threading of these warp threads. This is especially useful for the repair of major warp breaks whereby a lot of threads have to be rethreaded and must be knotted. An image of the threading on dobby machines then may provide an important support. This is especially useful to apply if warp threads with different colours are woven next to each other.

According to a fourth possibility, a visualization is provided in respect to the bobbins, more particularly the weft thread bobbins. Hereby, the colour of the different bobbins can be visualized on the machine terminal, together with the location on the bobbin rack, as well as the threading towards the different insertion channels. The operator then has to determine whether the actual condition is coinciding with the visualized theoretical condition, after which the weaving machine then only shall be started if this is the case.

In the applications whereby an image of the real fabric or of the actual fabric-determining elements is formed, this preferably is performed by means of a recording system on the weaving machine, for example, a camera system or a so-called on-loom inspection system. This may be an entirely photographic image, a processed image or an image which is derived from a scanning by means of the on-loom inspection system.

In the applications whereby on the machine screen, an image is represented which represents the condition as it should be theoretically, such image can be realized and supplied in different manners. For realizing the image, one may start from stored data from which the respective picture is chosen, for example, photographic pictures of a correct image, which are stored on a data carrier. One may also start from a computer-generated image. The supply of the information may take place, for example, in that the weaving machine can communicate with a server or such, which, in function of the requested data, is sending the desired image. According to another possibility, also local databases may be used which are stored, for example, in a memory pertaining to a weaving machine. Also, use can be made of data carriers in the form of diskettes, magnetic tapes or such, with which such information can be downloaded into the memory of a weaving machine or such. Of course, other possibilities are not excluded.

In the case that a server is used, it is preferred that all weaving machines of the weaving mill concerned are connected to this server by means of a data network. On the server, an application for production plans is running. In this manner, the server knows about the necessary article changes. The scenario for the verification of the weaving pattern is coupled thereto.

When the aforementioned possibilities are applied, such cooperation with the drive of the weaving machine can be provided for that, with well-defined deviations, the weaving machine may be stopped automatically.

According to a particularly preferred form of the invention, with a start of the weaving machine an image, such as aforementioned, is formed, either of the really formed fabric, or of the fabric to be formed, or of both, and, after starting the weaving machine, automatically a confirmation is requested whether the weaving process can be continued without any problems. By requesting this confirmation, the attention of the operator is directed to the fact that he has to perform a control.

According to a particular application, the weaving machine is stopped automatically if such confirmation is not given within a certain period of time. The confirmation possibly also can be given automatically, in the case that the control is performed automatically.

As aforementioned, it is known that an inspection system can be provided on weaving machines in order to control the fabric over the entire width, more particularly a so-called on-loom inspection system. A disadvantage with the use of the known inspection systems is that they are coupled to the weaving machine only in such a manner that the weaving machine is switched off by certain faults, without further information being available. According to a second aspect of the invention, the possibility is provided which renders such inspection system more efficient in an optimum manner.

According to this second aspect, the invention relates to a method for optimizing a textile production process, which comprises manufacturing a fabric on a weaving machine, whereby this fabric is controlled by means of an inspection system which is operative on the weaving machine, said system cooperating with the fabric, more particularly by means of a so-called on-loom inspection system, with the characteristic that at least a number of data of the detections performed by said inspection system is represented on the display of a machine terminal pertaining to the weaving machine. As a consequence of this representation, it becomes possible to provide detailed data for the operator on possible faults and such. Also minor faults, which not necessarily require a stop of the weaving machine, can be indicated.

The representation can take place in different ways. Preferably, however, it takes place by means of an indication on the machine terminal, accompanied by information, and/or by a visualization of the weaving fault in the form of an image or such, either a photographic representation of the fault, or a digitalized or abstract representation of the fault. By machine terminal, it is meant a display or screen which is integrated at the weaving machine and which also services as an interface for the machine functions, parameters and indications.

It is obvious that in this manner, the machine terminal forms a support for operator for the so-called trouble-shooting.

In another preferred form of the second aspect, when a weaving fault is visualized, a value cipher is allocated and entered, whereby these value ciphers are stored and processed for a produced fabric and, as a function thereof, a global value factor is allocated to the fabric. These value ciphers can be entered manually and/or automatically. Manually, this takes place according to the interpretation of the operator, in combination with the visualization of the weaving fault.

In this manner, a "grading" is created, in other words, a system of bad marks, whereby the number of bad marks forms a quality index for a roll of fabric. In this manner, for example, when the sum of bad marks for a given number of meters of fabric exceeds a defined standard, the fabric can be graded second-class.

According to another preferred form of said second aspect of the invention, data related to the weaving faults are transmitted to a computer-based trouble-shooting system, which formulates an answer and/or directly commands adjustments. In this manner, the operator almost directly has data available, as a result of which he can perform the necessary adjustments in order to correct faults and/or directly perform corrections.

Said trouble-shooting system is situated either in each individual weaving machine, or outside of the individual weaving machine, for example, on a central server, to which several weaving machines are connected by means of a network. The interface with the trouble-shooting system preferably takes place substantially from the machine terminal. In the case of a server application, this also can be performed from any terminal having access to the server and to the application on the server. This, for example, enables providing a screen in a separate room, which screen, for example, is coupled to a server which is connected to several weaving machines, such that an operator, in good working circumstances, can observe, judge and grade weaving faults of fabrics of different weaving machines. According to a variant, only certain weaving faults, which, for example, can not be judged or graded by the weaving machine itself, are transmitted to said screen, such that the operator only has to inspect and judge the faults which can not be judged by the weaving machine itself.

In accordance with this aspect, for example, the operation may be performed as follows. The operator starts the computer-based or computer-supported trouble-shooting system after visual interpretation of the detection photograph, which is represented corresponding to the first aspect of the invention, for example, on a weaving machine terminal. Based on an automatic classification of the detection and/or a digital analysis of the detection photograph, the computer-supported trouble-shooting system is fed with data, after which said system, as aforementioned, intervenes, either by providing information which allows for an intervention by the operator, or by intervening automatically, whereby the system then, for example, functions as a control loop, which automatically adjusts the relevant parameters of the weaving machine in order to optimize the quality of the fabric.

It is noted that in the a foregoing, the so-called on-loom inspection system can be placed anywhere along the produced fabric, either inside the actual chassis of the weaving machine, as well as outside thereof for example, when the winding of the fabric takes place next to the actual weaving machine.

According to another preferred form of the second aspect of the invention, on one hand, weaving machine data are determined and, on the other hand, the detected weaving faults are correlated to these weaving machine data. This offers the additional advantage that the causes of phenomenons, more particularly faults, can be determined and suitable corrective actions can be recommended and/or performed.

According to this preferred form, an automatic determination of the machine data and weaving conditions is provided for, such that, upon detection of a fault by the on-loom inspection system, the exact data are available, and can be stored, which were determining immediately before, during and immediately after the occurrence of the weaving fault concerned, at the location of the cloth line. The inspection moment, in fact, is situated a number of centimeters after the cloth line or beating line, as a result of which the information must be used with a certain delay.

Said machine data are, for example: stop information (kind of stop), pattern information, setting information, sensor output, automatic machine movements at stop and at start, automatic parameter variations in the period before stop or fabric fault (for example, variation in the weft density, speed variation, pressure variation), measured values such as: winding times, arrival times, alterations of the production flow rate.

Due to the correlation of the machine stop and/or the fault detection by the on-loom inspection system and/or by occurring parameters, parameter variations, respectively, thus causes of the phenomenon can be determined and corrective actions can be recommended, performed, respectively.

An application, for example, consists in that, when a stripe is occurring in the fabric according to the weft direction and it is known that there has been a machine stop at that point, one can assume that this is a starting stripe. Due to the correlation according to the invention, the weaving machine knows that here no further stop action has to be performed.

Another application of such correlation consists in that, when, after a warp stop, in other words, a stop after a fault in the warp has occurred, a stripe in warp direction occurs, the weaving machine automatically interpretes this as a faulty passage of a warp thread through the frames.

Further, it is known that the so-called on-loom inspection systems, more particularly the actual detection system thereof, are installed outside of the actual weaving machines, with the disadvantage that possible weaving faults are observed only after a longer period of time after the manifestation of the actual faults, which, especially in combination with the optimalization aimed at by the second aspect of the invention, forms a disadvantage. An example of the installation of such known on-loom inspection system is described in U.S. Pat. No. 4,702,283.

According to a third aspect of the invention, a solution for said disadvantage is aimed at.

To this end, the invention, according to a third aspect, relates to a method for optimizing a textile production process, which comprises producing a fabric on a weaving machine, whereby this fabric, by means of an inspection system present on the weaving machine, such system cooperating with the fabric, is controlled by means of a so-called on-loom inspection system, such that said inspection is performed in the zone where the cloth or the fabric is fed downward, in other words, the zone situated below the so-called sand roll. By performing the inspection at that specific location, in different respects a considerable optimation is obtained. On one hand, the inspection then is performed closed to the beating line, which, as aforementioned, is more advantageous in respect to the observation of weaving faults, and in respect to the possibilities of a faster intervention. On the other hand, the advantage is created in that an efficient incorporation of the on-loom inspection system inside the contour of the actual chassis of the weaving machine is possible, this at a location which is not hindering at all.

Such incorporation of an on-loom inspection system in the zone of the cloth roll can be applied in weaving processes whereby the fabric is wound upon a cloth roll which is situated substantially inside the actual chassis of the weaving machine, and whereby said inspection then is performed between said sand roll and the cloth roll, as well as in weaving processes where the fabric, at the fabric side of the weaving machine, substantially is fed downward in order to be directed further therefrom, either towards a cloth winding device next to the weaving machine, or to a cloth winding device which is situated at a level below the weaving machine. In the last case, said inspection then is performed between said sand roller and the location where the fabric is directed further.

It is known that with textile production processes, in particular weaving processes, a large number of operations take place, on the applied machines, for example, weaving machines, as well as around these machines. Thus, it regularly occurs that faulty operations are performed, that certain operations are rather complex and that certain operations are difficult to follow up. According to a fourth aspect, the invention aims at a remedy for this problem.

To this end, the invention, according to this fourth aspect, thus relates to a method for optimizing a textile production process, whereby one or more devices are applied, whereby at least at one of these devices, an identification and/or verification is performed by means of a contact and wireless system which utilizes identification elements. As a result thereof, identifications and/or verifications can be performed relating to objects, products and peripheral devices situated on the device concerned, for example, the weaving machine, or in the proximity thereof, as well as relating to persons.

Preferably, for the identification elements, use is made of so-called tags, responders or such which, for example, communicate by means of magnetic, infrared or radiofrequent signals. Of course, at the respective devices, for example, the weaving machines, then the necessary transmitting and receiving means are provided for making a wireless connection with the identification elements coming into the proximity of the device. Those identification elements are made such that they either are recognizable or are programmed such with relevant data, such as, for example, the identity of an object or a person, that differentiating is made possible. Also, such identification element according to the invention can be programmed by the device, for example, the weaving machine itself, or peripherical devices of such device themselves or can be additionally programmed at the moment that this identification element is detected.

Preferably, the identification and/or verification is applied for following up data and/or commanding parts of the aforementioned device or of peripherical devices thereof.

In the case that the identification and/or verification, as mentioned before, is performed in respect to persons, it is preferred that these persons are provided with a personalized identification element, whereby the personalisation can be performed per individual person, as well as per group of persons.

Preferably, the identification and/or verification is used for one or more of the following applications:

representing certain data at the device as a function of the identified identification element. This allows showing, for example, the appropriate initial page on the machine terminal, with specific information attributed to the detected person. Also, on the respective device a personal priority list can be called up by the operator, with an indication on which machine his following intervention has to take place, in other words, a so-called "to-do list". Those priorities may depend, amongst others, on the urgency of the intervention, the distance between the different devices or machines, the expected duration of the interventions and the priority of the woven article. Summarized, this results in an optimization of the path to be followed by the operator.

commanding certain machine functions at the device and/or commanding auxiliary accessories, peripheral devices, respectively, as a function of the identified identification element. As a result thereof, automatically certain machine parts can be commanded and/or brought into a certain status as a function of the person present at the device, for example, a weaving machine. So, for example, in order to save energy during normal operation, the lamps above the devices, for example, above the weaving machines, and in the case of the weaving machine, also possible lamps below the fabric, can be switched off, whereas, when an operator is detected in the vicinity of the device, these lamps are switched on, such that repairs and/or inspections can be performed. Another important application example consists in that protective covers, noise screens and such automatically are unblocked and/or opened when an authorized person is detected.

granting a personalized access right to the device or certain parts thereof In first instance, hereby an access right to certain data and/or setting possibilities is intended. These access rights thus define reading and/or writing rights in respect to each individual parameter. Hereby, it is intended that, for example, a foreman gets reading and/or writing access to setting parameters of the machine, a doffer only gets reading and/or writing access in respect to the piece length of the fabric and the resetting of these data; a weaver gets reading access to machine parameters, however, no writing access; etc.

realizing, by means of the device, a personalized communication with the person present at the device. Through an available server, by means of the detection by the identification elements, one may obtain knowledge of the location where the staff is active, a report or instruction can be transmitted to the operator, in the case of a weaving mill, over the weaving mill network, and can be represented on the machine terminal at the respective device, for example, a weaving machine, where the operator is present at that moment.

following up interventions. By means of such follow-up, different characteristics of an intervention can be controlled, for example, in order to be applied for optimizing the general planning in weaving mills. An application hereof consists in following up the average intervention time per type of intervention, in order to plan and determine priorities of actions in the future. Another application consists in building up an intervention history, together with following-up the time consumed per machine, from which it can be determined which machines must be filed as problem machines and/or come into consideration for further inspection, analyse, respectively. Also, by means of this follow-up, a picture of the working load of the operator can be determined, which then can be calculated into the determination of the allocation (for example, the number of machines per weaver, taking the article into account) and the production planning.

In the case that the identification and/or verification is performed in respect to products, hereby all kinds of products may be concerned. By the term "products", hereby thus also must be understood: auxiliary devices and/or parts which have to cooperate with the respective device, for example, weaving machine; products which are supplied to the respective device; products which are transported off the respective device.

The invention is particularly useful with weaving machines and/or peripherical devices of weaving machines.

Preferably, it is applied in combination with the use of one or more of the following products, auxiliary devices, respectively: bobbins, the warp beam, the cloth roll, a cleaning installation and spare parts.

In the case of the application with bobbins, the identification preferably takes place by means of, on one hand, identification elements provided at the respective bobbins, more particularly at the spool of the bobbin, and, on the other hand, detection means which are present in or at one or more pins of a bobbin rack, which can cooperate with said identification elements. Hereby, preferably a low-cost electronic identification tag is used which is present at the bobbin itself, such as, for example, a sticker with an integrated chip and antenna which is provided in the bobbin spool, whereby this tag comprises all relevant data concerning the yarn present on the bobbin, such as the composition of the yarn, the colour, the yarn number, used units, and so on.

In the case of the application with bobbins, the invention preferably provides for one or more of the following applications:

identifying a bobbin in order to verify it with the data of the article to be woven. Thereby, when installing the bobbin, it can be directly determined whether it is a correct bobbin or not.

generating a signal related to the necessity of supplying new bobbins. Thereby, the attention of the operator can be drawn to the fact that a bobbin change must be performed. Hereby, for example, in a known manner, when no bobbin is detected on a pin, or when a bobbin change signal is generated by a separate detector, a signal can be generated for supplying bobbins. The generation of such signal can take place by an indication on the machine terminal and/or by means of a signal lamp and/or by an indication on a separate terminal on which a surview of machines needing bobbin supply and the required bobbin type are shown By thereby taking into account the specific data of the bobbins which are known due to the identification elements of the bobbins, an indication can be given of the period of time in which bobbins are required.

generating a signal related to the necessity of supplying a new bobbin, taking into account the remaining weaving time and/or weaving length to be expected. Taking into account all bobbins on one and the same weaving machine, or on different weaving machines, an optimum period of time for supplementing bobbins can be chosen, taking into account the different factors obtained by said identification elements. Hereby, the optimum period of time for sending an operator to the machine can be concerned, as well as for moving devices used therewith and/or the new bobbins to the respective weaving machine. Due to the detailed follow-up, which is possible as a result of the information obtained by the identification according to the invention, it is possible to follow the necessity of bobbin replacement very precisely, and in this manner, for example, in certain cases one may better wait instead of replacing an empty bobbin immediately, until other bobbins have to be replaced, too, such that the replacement can be performed in a single intervention. Also in respect to the interventions on different weaving machines, then an interaction can be realized, such that, for example, the supply of new bobbins for weaving machines situated in their mutual vicinity can take place together.

following-up stop ciphers in function of the supplied bobbins. Hereby, a quality index can be allocated to each batch of bobbins and can be fed back to the supplier and/or the production of the bobbins. When with a certain batch of bobbins, a stop cipher is obtained which exceeds a limit value, the batch of bobbins automatically can be provided with a mark and one thus may decide to block these low-quality bobbins and no longer weave them.

adopting the transporting-off of the weft thread as a function of the bobbin diameter, by making the bobbins unique and, from the use thereof, deduce the diameter. It is known that very large bobbins, as well as small, almost finished bobbins, especially in wool, become problematical with high pull-off speeds. By rendering each bobbin in a weaving mill unique by means of an identification element, it is possible, in cooperation with data of other sensors, to make an estimation of the diameter and adapt the insertion or, with a first subsequent weft thread break, to request a weaver to replace the bobbin, the knowledge of the length of thread on a bobbin, the weft length on the weaving machine, the number of inserted thread lengths since the starting of the bobbin, the original diameter of the bobbin, the diameter of the spool and such, in combination with the use of an identification element according to the invention, makes that each bobbin is unique and that, when detecting the bobbin, one always knows whether it is a full or an already partially woven bobbin. The respective data are stored on a server and/or on the identification element of the bobbin itself.

identifying bobbins, in particular bobbins installed at a bobbin rack, in order to verify whether the identification data of these bobbins correspond to the data of the article to be woven. In other words, according to this possibility of the invention, the identification elements which are provided at the bobbins are used for the identification of the bobbins present on the pins of the bobbin rack in order to verify whether the correct bobbins are placed on the respective pins, i.e., to verify whether each bobbin installed at a particular pin is a correct one for the article to be woven. More particularly, due to the fact that, by means of the identification element, it is possible to identify which type of weft thread is present at the bobbin, it can be verified whether this type of weft thread is in accordance with the data of the article to be woven.

using the identification of the bobbins in order to weave an article according to a weft insertion pattern that is determined as a function of the kind of the weft threads. According to this possibility of the invention, the identification elements provided at the bobbins are used to optimize the supply of weft thread when weaving articles having weft insertion patterns which are obtained by using different kinds of weft threads. For each kind of weft thread, the weaving machine contains an insertion channel which comprises a bobbin with this kind of weft thread, preferably a prewinder device and a device for feeding this kind of weft thread to the shed.

Hereby, a weft insertion pattern can be entered in the machine terminal or the central server as a function of the kind of the weft thread to be inserted. Using the identification elements, the weaving machine can determine, for each kind of weft thread, the insertion channel corresponding to that kind of weft thread, and can convert the entered weft insertion pattern as a function of the kind of the weft thread to a weft insertion pattern as a function of the insertion channels. This enables one to place the bobbins with different kinds of weft thread, more particularly with the kinds of weft thread required for forming the pattern to be woven, on any pin of the bobbin rack, regardless of the place of the bobbin on said rack. This offers the further advantage that, if no weft thread of a certain kind is present on the bobbin rack, the weaving machine will detect this, will interrupt the weaving process and can display a message on the machine screen that a certain kind of weft thread is missing. This offers the further advantage that, when changing the article to be woven, in particular the weft insertion pattern to be woven, the bobbins which can be used further on can remain on their pin of the bobbin rack and the new bobbins can be placed on any pin of the bobbin rack which becomes available. It is clear that in this way, no longer a particular relation is required between, on one hand, the place of each bobbin on the bobbin rack and, on the other hand, the weft pattern of the article to be woven, contrary to the conventional systems.

In the case that the wireless detection and verification, identification, respectively, is applied in combination with a warp beam of a weaving machine, there are two important application possibilities.

According to a first application possibility, the identification elements according to the invention then are used for the identification of the warp beam in order to verify the latter, together with the warp threads present thereon, with the data of the article to be woven. On each warp beam and/or module comprising a warp beam, an identification element is provided with all relevant information of this warp beam. In this way, it is, for example, possible, when installing the warp beam into the weaving machine, during a beam change and/or article change, to identify the identification element by a reading device on the weaving machine, and to compare it to the specifications of the article to be woven, which specifications are present at the weaving machine and/or on the server. With an incorrect warp beam, this is signaled, for example, by means of the control of the indication lamps usually present on a weaving machine, or by means of an indication in another manner, for example, on the machine terminal. With an incorrect beam, weaving with this machine can be blocked automatically.

According to a second application possibility, the identification of the warp beam takes place in order to have specific data of this warp beam from its history available, in order to take these into account when weaving. As it is known which specific warp beam is present on which specific weaving machine, the history of the specific warp beam indeed can be used during weaving. When constructing this history, each occurrence, for example, when forming this warp beam, can be coupled to a specific position of this warp beam. When weaving off this warp beam, these positions can be followed up and related to the position according to the warp direction in the warp beam situated in the weaving area at any moment. When, for example, during a certain period of time in the preparation of the warp beam, problems have occurred, it may be expected that this will lead to an increase of a number of machine stops and/or weaving faults. When detecting these stops and/or faults, this can be correlated in real time to the lower quality of the beam in this position. This can be reported on the machine terminal and taken up in reports of the production follow-up system. This previous knowledge means that the problem is not related to the machine and/or that the problem does not depend on the machine settings. As a consequence, in most of such cases, no so-called trouble-shooting action will be started, but one will wait until the problem area of the warp is completely woven, before the normal interpretation of the machine operation is taken up again. Another method may be to reduce the speed of the weaving machine automatically when approaching such an area in the warp beam.

In the case that the method according to the invention is applied with a cloth roll, according to a preferred form of embodiment one or several of the following applications are realized:

providing data on the cloth roll by providing it with identification elements. This takes place by providing said identification elements on the cloth roll, either on the fabric itself or not. By afterwards detecting the provided identification elements, one knows, when further processing the fabric, when it is necessary to pay attention to certain irregularities, faults, particularities and such.

providing data on the cloth roll by providing identification elements, by adhering such identification element, if necessary, onto the cloth roll or the cloth by means of an automatic application device. To this end, preferably at the weaving machine an electronically controlled, using wireless or not, apparatus is built in, which can adhere identification elements, for example, self-adhesive tags, onto the just formed fabric, somewhere in the zone from the beating line up to and including the circumference of the cloth roll. With a machine stop or another irregularity, then automatically an identification element can be adhered onto the fabric, at the height location where the stop has occurred, of shortly before that, or shortly after that, thereby taking into account the distance between the beating line and the position of the apparatus. Thereby, during the final inspection all these tags can be electronically detected and controlled for possible weaving faults. According to a variant, also an inkjet mark or another identification means can be provided on the fabric, whereby, for example, the colour of the ink is related to the weaving fault.

automatically performing one or both of the afore-mentioned applications as a function of an automatic detection of a fabric fault. Hereby, for example, fabric faults can be followed up by an on-loom inspection system, and upon detection of a fault, automatically an identification element can be provided at the fabric.

providing data on the cloth roll by applying identification elements which are on site programmed and/or provided with relevant information. To this end, the weaving machine, and more particularly, the apparatus for applying identification elements, preferably are equipped with a programming unit which programs the identification elements, for example, said self-adhesive tags, with all relevant information regarding the stop or fault detection. Programming the identification element takes place either before said element is provided on the fabric, by means of a unit which is situated on or before the part of the apparatus by which the identification elements are provided on the fabric, for example, adhered thereto, or after such identification element already has been attached to the fabric, by means of a unit which is mounted behind said apparatus, more particularly behind the part by which the identification elements are provided on the fabric.

providing data on the cloth roll by applying identification elements which are provided with a visually recognizable mark, more particularly a readable text or a readable code. Thereby, a visual recognition by the operator is possible, in each process, during or after the weaving process.

providing, when removing the cloth roll from the weaving machine, i.e. the so-called doffing, an identification element on the cloth roll with information for logistic purposes.

providing on or at the cloth roll one or more identification elements for different purposes, whereby these are provided, as a function of the purpose, in different positions in the longitudinal direction of the cloth roll. Thereby, the same identification elements, for example, tags adhered onto the fabric, can be applied for different purposes, whereas nevertheless a possible interference during reading is excluded. In a practical form of embodiment, for example, identification elements with logistic purposes and/or information are adhered to one edge of the cloth roll, whereas identification elements with qualitative purposes and/or information are provided next to the other edge of the cloth roll. Due to the coupling of the planning system and the logistic follow-up of the products in the textile production, a tracking system can be built build up which can inform at each moment which is the condition of each order of a fabric, such for each client. Also, the quality information per cloth roll then can be coupled thereto. This tracking system can be made available for the clients of the weaving mill, for example, by means of the internet, which clients at each moment can "trace" and judge their own orders.

transmitting, by means of the identification elements provided on the cloth roll, information towards a later repair. Hereby, during the repair automatically data can be made available which are useful for performing the repair itself in the preceding application, at least applying information which allows to have the fabric rapidly run to the right repair points, whereby a stop will be made only at repairable faults. It is known that a variety of weaving faults are repaired afterwards. By now indicating, by means of the identification elements provided on the fabric, whether a fault is repairable or not, for example, by programming this into the identification element, it is possible to have the fabric, during repair, run rapidly towards the right repair points, whereby the so-called rewinding of the fabric only is stopped at repairable points. The programming of the data necessary to this end into the identification element may be performed by an operator, either at the weaving machine, by means of visualization of the fault, or the machine terminal itself and by the input thereof at the machine terminal, either by an operator who surviews the photographs of the faults in a cloth roll on a separate screen and is entering the relevant data, or during the inspection, where the operator, by visual interpretation of the fabric, enters the relevant data. In combination with an on-loom inspection system, the programming of the "repairability" data into the tag also can be performed by means of automatic interpretation of the detection and/or photographs of weaving faults.

Said optimization by means of the use of said identification elements can also be applied in combination with the use of a cleaning installation, more particularly a so-called "overhead cleaner". Such cleaning installations consist of devices which can be moved along, and in the case of an "overhead cleaner", over various weaving machines of a weaving mill and which, by means of a forced stream of air, blow away dust and such out of the weaving machine, suction it off therefrom, respectively. According to the invention, such identification element also can be provided at such cleaning installation which can cooperate with transmission and detection means at the weaving machine or the like. The identification element can be attached, for example, to an arm, blowpipe or suction pipe of the cleaning installation.

Preferably, one or more of the following applications shall be provided for:

following-up the frequency with which cleaning operations are performed by means of the cleaning installation. Hereby, the weaving machine detects when the cleaning installation passes along the weaving machine. The weaving machine then can generate a signal when such cleaning installation does not pass frequently enough and/or when the time that such cleaning installation has passed for the last time, exceeds a certain period of time. This period of time can depend, for example, on the article concerned. Hereby, the signal of the weaving machine can provide for commanding the signal lamps, the machine terminal, the cleaning installation itself, or the like.

following-up the frequency with which cleaning operations are performed and/or the frequency with which a cleaning installation at least passes along a weaving machine, and correlating stops of the weaving machine and/or detections of a fabric inspection system to said frequency. Thereby, it is possible to research whether the cleaning installation is a cause for the introduction of weaving faults and/or machine stops. This can be indicated in a variety of ways, amongst others, by commanding indication lamps on the weaving machine, by messages on the machine terminal, by logging or by a visualization by means of the server software.

determining whether the cleaning installation is switched on at the moment that it passes along the weaving machine. Usually, cleaning installations permanently move through a weaving mill. In certain cases, it is desirable that such cleaning installation is not switched on during each passage. As the passing of a cleaning installation now easily can be detected, the weaving machine also can decide whether the cleaning installation will be switched on or not, for example, as a function of the woven article and the time passed since the last cleaning action.

A particular application consists in that, by means of the use of identification elements, a follow-up of the consumption of spare parts is realized, preferably per weaving machine or per operator. To this end, the respective spare parts are equipped with identification elements, such as said tags, which can be read-in by the weaving machine. All data are put into a server and/or the weaving machine. Thus, the consumption of spare parts per machine can be followed up. When also the identification element of an operator is read-in, also the consumption of spare parts per operator can be followed-up. The history of the consumption of spare parts in each individual weaving machine is important for the so-called trouble-shooting. So, for example, the regular, necessary replacement of one and the same part at one and the same machine can be taken as an indication that there is a fundamental fault in this weaving machine at the location concerned.

It is noted that according to the invention, the identification or verification in respect to a certain device, more particularly, a weaving machine, as a function of certain factors also can be performed by means of another device situated in the proximity of the first device, at least if the devices concerned, for example, weaving machines, are coupled to each other by means of a network. When, due to one or the other cause, for example, a power failure on a weaving machine, the identification element can not be read-in, this latter, for example, can be read-in by means of an adjacent weaving machine and be allocated to another machine by means of the machine terminal.

It is known that the settings of the weaving machine, as well as data originating from a weaving machine, always are entered, read-out, respectively, by means of a terminal or such. From practice, this has proven to be not always very manageable. According to a fifth aspect of the present invention, this disadvantage is remedied.

According to this fifth aspect, the invention thus also relates to a method for optimizing a textile production process, which consists in producing a fabric on a weaving machine, whereby either peripherical devices are applied on the weaving machine or not, with as a characteristic that to this end, a communication is provided for between the weaving machine and/or the peripherical devices and a portable computer system, such as a PDA (Personal Digital Assistant) or a portable PC (Personal Computer) or such, whereby the portable computer system serves as a data carrier for machine data and such. With this communication, data originating from the PDA or the portable PC preferably are exchanged by means of a wireless connection between, on one hand, the weaving machine and, on the other hand, the PDA and/or PC. The data which can be exchanged thereby, are, for example: machine settings, weaving patterns, software updates, production data.

The PDA and/or PC may also comprise, for the operator, personalized access rights to the weaving machine.

In a particular application, the PDA or PC or such shall be applied for transmitting data, as well as for installing software updates in the computer unit of the weaving machine. Hereby, the necessity of using expensive cards, as this is the case up to the present, is excluded.

It is known that, as a function of the article to be woven, different parameters can be set at the weaving machine, such as the time of the arrival of the weft thread in the weaving cycle, the braking angle of the weaving machine, the temperature of the rapiers in the case of a gripper weaving machine, and many other parameters. In the known embodiments of weaving mills, it is often difficult to maintain a control of all these parameters. According to a sixth aspect of the invention, an optimalization is offered which minimizes the aforementioned problem, if not excludes it.

Thus, the sixth aspect of the invention relates to a method for optimizing a textile production process, consisting in manufacturing a fabric on a weaving machine, with as a characteristic that the weaving machine, together with other weaving machines, is connected to a central server by means of a network; that a server is used which comprises the standard settings of different weaving articles, with possible variations which may occur; that, by means of the server, all respective actual machine settings of the weaving machines are compared to a corresponding standard setting; and that certain deviations are signaled and/or that in function of certain deviations, an automatic intervention takes place. In this manner, a particularly smooth and easy to survey control can be performed. The signalisation can take place by commanding indication lamps on the weaving machine, by representing an indication on the machine terminal or by a "flagging" in the reports of a production follow-up system.

Further, it is known that with textile machines, amongst others, weaving machines, often the same information must be entered, as certain information from certain machines also is useful for other machines. In practice, the aforementioned repeated entering of information often is time-consuming, and much useful information gets lost as it is well available for one machine, but not for another. According to a seventh aspect, the invention aims at an optimalization remedying this.

According to this seventh aspect, the invention thus also relates to a method for optimizing a textile production process, consisting in manufacturing textile products on a plurality of textile machines, with as a characteristic that data are exchanged between the respective textile machines. In this manner, the repeated input of the same information on different machines can be excluded in a simple manner, by transferring the information from one machine to the other.

According to a particular form of embodiment, the data are exchanged directly, without the intermediary of a server, for example, by means of direct communication among the textile machines or, as explained in the aforementioned fifth aspect of the invention, by means of the intermediary of a PDA, PC or the like.

According to the invention, the data can be transferred either by means of a command upon the initiative of a textile machine itself or upon the initiative of an operator, or upon request of another textile machine.

In a practical form of embodiment, each textile machine is seen as a node which is connected to an ethernet network and has its own IP address, in the case that the information is exchanged directly, without the intermediary of a server. Knowledge of the connection between the machine number and the IP address allows to transmit data from one node of the network to another node.

The kind of data to be mutually transmitted may be varying. Examples thereof are data related to machine settings, weaving patterns, applications, complete or partial versions of machine software, access control lists, and so on.

It is known that textile machines, and more particularly, weaving machines, consist of a considerable number of parts. Thus, with repairs, it is not always simple to identify the parts to be replaced in order to come to an order or such, and it is particularly difficult to know in advance whether a repair can be realized in a short time, more particularly, whether new parts, which are necessary for the repair, will be available in short time. According to an eighth aspect of the invention, an optimization is provided which remedies this.

According to this eighth aspect, the invention thus relates to a method for optimizing a textile production process, whereby textile machines and/or peripherical devices are applied, with as a characteristic that use is made of a machine terminal or such pertaining to and/or coupled to the textile machines and/or the peripherical devices, whereby this machine terminal or such is applied as a user interface for a so-called maintenance management system. The machine terminal or such hereby basically may consist exclusively of a display for calling up written data relating to spare parts which are necessary for performing repairs however, preferably a machine terminal will be used with which also images of the pieces concerned can be called up, together with related information, such that a visual control is possible. Hereby, a direct application of the actual machine terminal is most recommended, as the latter always is present at the machine itself, however, the application of an extern terminal to this purpose, coupled to the weaving machine, for example, a PDA or portable PC, is not excluded.

Preferably, by means of said user interface, a communication is realized between the textile machine, for example, weaving machine, and a database with data relating to parts of different textile machines, more particularly, different weaving machines. Thereby, this database can be consulted for obtaining in this manner information relating to the necessary spare parts, directly at the weaving machine where the defect has occurred.

In the most preferred form of embodiment, a communication by means of the user interface is possible, according to one or more of the following aspects:

- calling up, from the machine terminal, a history of actions performed beforehand relating to the respective machine, such that possible useful data relating to the repair and/or replacement to be performed can be derived therefrom;
- when starting up an intervention, automatically transmitting data which enable identification of the machine, such as a machine number or serial number;
- identifying, from the machine terminal, the respective spare parts by means of an online catalog;
- consulting a local stock;
- performing an order;
- indicating the degree of urgency when ordering.

In this manner, a catalog of spare parts is obtained which can be consulted from a textile machine, more particularly from a machine terminal, whereby according to a preferred form of embodiment, also an interactive working is possible, as, by means of the machine terminal, also orders can be placed and/or a stock control can be performed.

An example of a scenario to be followed hereby is as follows:

1. The operator notes a malfunction at a textile machine, more particularly, a weaving machine, and diagnoses that a part is defective.
2. From the machine screen or the machine terminal, possibly a history of actions performed beforehand cam be called up in order to possibly make a connection with the action to be performed presently. This may relate to the history of the textile machine concerned, or of another similar textile machine which is coupled, for example, directly or by means of a server, to the textile machine concerned.
3. The operator starts an intervention, by means of the machine screen. The machine number, which, in the case of a weaving machine, for example, is allocated by the weaving mill itself, and the serial number, which is a number allocated by the manufacturer of the machine and which is coupled to the embodiment thereof, are automatically transmitted to a server or the like. The server then automatically allocates an intervention number. Hereby, it is noted that the session possibly also can be started from an adjacent machine, whereby the operator then of course has to apply the machine number of the defect machine instead of the number of the machine on which the session has been started up.
4. The required part is identified by means of the online spare parts catalog, which may take place, for example, in two manners, by means of navigation, with which is meant that a final identification is obtained by means of the assembly group, the assembly and the part number, or by means of searching directly by the part number, respectively.
5. The necessary parts are taken up in a list of "required parts", in other words, in a so-called "shopping basket".
6. This list of "required parts" can be consulted at any time.
7. Stating from this list, one may consult the local stock or place an order. This order can be accompanied by a degree of urgency.
8. When all parts are present, the repair can be performed and thereafter be checked.
9. The in/out operations at the stock are performed from a terminal in the stock itself.
10. A list of interventions to be performed can be called up at any machine.

The commands which have to be given in a practical form of embodiment, then may be, for example, of the kind as represented hereafter, by way of example:

1. The starting up and closing of an intervention:

When starting up, for example, first a screen for realizing a "workorder" will turn up. On this screen, different fields are available which either are filled in automatically or not, amongst which preferably fields for: the machine number (number of the machine in a weaving mill), the machine's serial number (manufacturer's number), the workorder number, the symptoms, the actions to be taken.

When starting up, also browsers are started from a pictogram on the machine display, as a result of which browsing is possible between machine numbers and machine's serial numbers.

The machine number which is displayed automatically will be, by default, the number of the respective machine. When starting up the browser, the "URL" is given, together with the machine number and the machine's serial number.

Default starts up the screen for defining a new intervention, if there is no "pending workorder". If an intervention is already "pending", then this becomes active as a default. By means of a portion present on the display, which, for example, can be activated by touch, however, a new workorder can be chosen.

With a new workorder, the aforementioned field "symptoms" initially is empty and must be filled in by the operator. This can be performed either by means of a separate keyboard, or by means of a keyboard which temporarily can be called up on the screen and can be touch-commanded. So, for example, one can enter: "transporting-off waste irregular". Once this is entered, it remains in the memory for the workorder concerned, until it is deleted or altered.

With a new workorder, said field "action" initially also is empty and must be filled in by the operator. Hereby, the action is filled in which the operator considers necessary. So, for example, may be filled in: "cutter of edge-cutting apparatus defect—cutter blades to be replaced".

By means of a field or button provided especially for this purpose, possibly the "history" can be called up, as a result of which preceding interventions can be viewed. The latter may comprise useful information related to the present intervention.

After putting in the fields "symptoms" and "actions", the operator has to activate a field, called, for example "create workorder". As a consequence thereof, the server allocates an intervention number for the machine concerned. This number is displayed, together with the date, in said field "workorder number". At the same time, then, for example, the buttons or fields "required parts" and "spare parts catalog" are shown. From this moment, the intervention is a "pending workorder".

By means of the field "required parts", a list of spare parts can be compiled which are necessary for the intervention.

By means of the field "spare parts catalog", a screen can be called up from which a spare parts catalog can be consulted for calling up and reserving the required parts. The use of this "spare parts catalog" will be explained more detailed in the following.

Possibly, in an additional field, for example, indicated by the inscription "cause", an explanation can be filled in by the operator on the cause which led to the necessity of the intervention concerned.

By means of an "exit" button, one may leave the respective screen.

The "pending workorder" created in this manner always can be called back upon the screen.

2. The catalog and the use thereof in order to identify and order parts.

When calling up the "spare parts catalog", preferably first an image of the global weaving machine is shown on the machine screen, together with indications of the different units thereof numbered, for example, as "A1", "A2", "A3", . . . Herein, "A19", for example, represents the complete assembly group related to the weft insertion.

These indications may consist of simple notes which then can be filled-in in a field, or in their turn may consist of touch fields, such that, by touching them, the search for the respective parts automatically is narrowed onto exclusively the assembly group concerned. At that moment, an "assembly" list can be shown which lists up all parts of the respective assembly group. This "assembly" list then comprises, for example, the indication of the assembly group, the assembly number, the denomination and possibly still other data, and may look as follows:

. . .

A19 150456 001.002 SUPPORT

A19 150760 001.003 SELVEDGE CUTTER

A19 150800 001.002 REEL HOLDER 1 MM RHS

A19 150803 001.001 REEL HOLDER

A19 150878 001.002 WASTE WIND-UP

A19 150885 001.001 SPLIT MOTION

Also, on all screens where searching is possible, a search field can be present, for example, indicated by "find part", wherein a part number or a word can be filled in, which leads to a screen with searching results.

In the "assembly" list called up as aforementioned, or in the results found by means of the "find part" order, then an item concerned can be designated, for example, by means of a bar represented on the screen, which bar can be moved up and down.

By subsequently pushing a button "exploded view" shown on the screen, a view, more particularly an exploded view, is given of the assembly selected by means of said bar. In the case of, for example, the cutting device for the selvedge ("selvedge cutter" in the aforementioned assembly list), this cutting device is represented in all its composing parts, which can be ordered separately, whereby each part which can be ordered individually is provided with a reference number.

By means of a "view list" button hereby displayed on the screen, one may go from the screen "exploded view" to a list in which the parts indicated with references in the "exploded view" screen are taken up and further information thereon is given, such as the actual part number which is necessary for ordering, as well as the denomination. Such list then, for example, looks as follows:

| | |
|---|---|
| 11 BA213941 | SHAFT |
| 12 B 160090 | DISC |
| 13 ESIMD 5 | LOCK NUT |
| 14 B 162176 | SPRING |
| 15 V30D 3X12 | SCREW |

Apart from said list, a field or button is present for listing, ordering, respectively, the desired parts, for example, indicated by the inscription "is required". By making a selection in said list and activating this field or this button, the data is stocked as being required. Hereby, it may also displayed in the list how often a certain part is present in the "assembly", whereby this quantity automatically is entered by activating the "is required" field. The quantity, of course, can be altered by means of the screen, before it is entered, for example, when no complete replacement of the "assembly" concerned is necessary.

In said manner, a list of necessary parts can be drawn up, which list, for example, can interact with stock data, for example, by means of a coupling to a database. Such list, for example, looks as follows:

| | PART RESERVATION | | AVAILABILITY | |
|---|---|---|---|---|
| PART | required | reserved | stock | outstanding order |
| BA213941 | 1 | 0 | 2 | |
| B 162176 | 1 | 0 | 0 | 7/12.01.2001 |
| B 163175 | 1 | 1 | 2 | |

In the rubric "required", the number of parts necessary for the intervention is indicated. In the rubric "reserve", the number of parts is indicated which already is reserved for this intervention In the rubric "stock", the number of parts is shown which momentarily is available in stock, excluding the parts already reserved for other purposes. In the rubric "outstanding order", the number of already ordered parts for filling up the stock is shown, together with the earliest delivery date of the parts ordered, but not yet reserved.

Apart from said list, different fields may be shown, such as:

"reserve from stock": as a result of which the selected part can be reserved from the available stock;

"reserve from outstanding order": as a result of which the part selected in the list can be reserved from the parts already ordered;

"purchase order": with which one can go to an order screen for ordering the selected part and for performing the actual reservation.

Finally, one ends up on an order screen in which different data are shown, such as the price, the earliest delivery date and the like, and in which also data can be filled in by the appellant, such as the desired delivery date, the urgency, in order to possibly obtain priority in respect to other orders, and so on. By means of this order screen, the reservation and/or order then finally can be confirmed.

It is known that with weaving machines, different settings have to be performed as a function of the article to be woven, and, as a function of the settings, different fabric aspects can be obtained. Also, certain weaving faults often depend on the kind of a certain fabric. Thus, often it is no simple task to adjust a weaving machine such that it works in an optimum manner. According to a ninth aspect of the invention, an optimization is aimed at which allows to adjust machines as optimum as possible, as a function of the article to be woven.

According to this ninth aspect, the present invention thus relates to a method for optimizing a textile production process, whereby this textile production process consists in manufacturing equal or similar textile products on textile machines, with as a characteristic that between the respective textile machines, an automatic dialogue is performed, by means of detected control parameters and settings as a function of which dialogue the command of one or more of the machines is optimized.

Hereby, preferably a dialogue between machines with one and the same article is started automatically by means of software modules within each machine. Hereby, the machines, amongst others, are mutually comparing their informations on efficiency, quality, stops and faults in real time. In the case of a weaving machine, in combination with an on-loom inspection system, also the detections of weaving faults and the woven fabric aspect of the different machines can be added to this information.

On the basis of a comparison, then mutually deviating parameter values and such between the respective textile machines, more particularly weaving machines, can be automatically adapted to the values of the best-performing machine. Such regulation loop can be-controlled from a server software and/or from software residing on each machine, so-called "intelligent agent" software, thus, without the intermediary of a server and/or controlled by a combination of both.

Based on this comparison and experience, for each parameter an allowed variation can be allocated, within which efficiency and quality remain acceptable and within which the parameters do not have to be adapted.

In order to further optimize all necessary communications and to perform them smoothly, according to a tenth aspect of the invention, use can be made of wireless communication means which realize connections by means of a public telephone network. According to this tenth aspect, the invention thus relates to a method for optimizing a textile production process, whereby this textile production process consists in manufacturing one or more fabrics on one or more weaving machines, with the characteristic that the weaving machines can communicate with one or more other weaving machines and/or with one or more other systems, whereby this communication is realized by means of a wireless telephone device which cooperates with a public telephone network, such as a cellular phone or such or any public data communication network. This wireless telephone device, by which also an incorporated wireless module must be understood, is coupled directly to the weaving machine and can be applied for purposes, such as support maintenance and periodical follow-up.

A disadvantage with the present weaving machines consists in that it is often difficult to transmit information regarding a weaving process or the weaving machine to interested parties. According to an eleventh aspect of the invention, a solution therefore is offered.

According to this eleventh aspect, the invention relates to a method for optimizing a textile production process, which consists in manufacturing one or more fabrics on one or more weaving machines, with the characteristic that hereby, use is made of a digital photographic device or camera which is and/or can be coupled directly to the weaving machine, whereby the digital images are transmitted from the weaving machine, by means of a communication system, for further use. In this manner, a direct follow-up from outside is possible in practice, to this aim digital images from a photographic device or a camera can be transmitted, by means of cellular phone or by means of a weaving-mill network, a weaving-mill server or by the internet, to the interested party.

According to a twelfth aspect of the invention, a further optimization is aimed at, having the purpose of minimizing disadvantages which, as known, occur in weaving mills as a consequence of ambient factors, such as temperature of the weaving workroom, the temperature of the weaving machine or of the oil of the weaving machine, vibrations of the weaving machine, vibrations of the floor of the weaving workroom around the weaving machine, dust pollution and humidity. According to this twelfth aspect, the invention to this end relates to a method for optimizing a textile production process, which consists in manufacturing fabrics on several weaving machines in a weaving mill, with the characteristic that, by means of sensors provided on the weaving machines, ambient factors, amongst which, preferably, at least the temperature and/or the relative humidity, are followed up. By means of this follow-up, a global representation of the conditions in a weaving mill can be built up, as a result of which possible limitations on certain weaving machines as a result of too disadvantageous ambient factors can be evaluated and possibly suitable measures can be taken in order to influence the ambient factors.

Preferably, the ambient factors are followed up in a central system, such as a server, whereby, by means of this central system, a control is performed, correlated according to the measured ambient factors, and/or, by means of this central system, devices are commanded which must effect on said ambient factors in an advantageous manner.

In order to realize the above-mentioned in practice, sensors for relative humidity and temperature are connected to the weaving machines. The weaving machines concerned can read out these sensors. Then, the measured values can be transmitted to a server, by means of the network to which each weaving machine is connected. In reverse manner, the server also can ask for the sensor values at each weaving machine. By coupling such sensors to a number of chosen weaving machines in the weaving mill, a lay-out can be made up on the server which gives a representation of the ambient parameters in the weaving mill, for example, with an illustration of isotherms and iso-"humidity" lines. Subsequently, these data can be correlated to the stop cipher of the machines and their positions in the weaving mill, from which then the necessary consequences can be drawn. These data also can be used for optimizing the regulation of the airconditioning in a weaving mill.

A thirteenth aspect of the invention can be used when the weft tension of the weft thread is measured as a function of the position of the main shaft of the loom and/or as a function of the corresponding position of a weft thread brake element of the loom. According to this aspect, a characteristic of the weft thread tension can be shown on the screen as a function of the position of the main shaft and/or as a function of the corresponding position of the weft thread brake elements. This aspect of the invention offers the advantage that the weft tension can be shown on the screen in an easily understandable and interpretable form to any operator.

A fourteenth aspect of the invention can be used when the tension of the warp threads is measured as a function of the position of the main shaft of the loom and/or as a function of the corresponding position of a shed-forming means. According to this aspect, a characteristic of the warp thread tension in the upper warp and/or a characteristic of the warp tension in the lower warp can be shown on the screen as a function of the position of the main shaft and/or as a function of the corresponding position of the shed-forming means. This aspect of the invention, which either can be used in combination with one or more of the other aspects or not, offers the advantage that the warp tension can be shown on the screen in an easily understandable and interpretable form to any operator.

It is clear that the invention also relates to methods whereby the aforementioned optimization possibilities can be combined according to two or more of the aforementioned aspects, whereby an interaction between said techniques can be provided for.

Thus, the fourth aspect of the invention can be combined, for example, with the fifth aspect, whereby the arrival of an operator with a well-defined identification element automatically results in that this operator obtains reading and/or writing access to well-defined data which he then can read, enter, respectively, by means of his PDA or portable PC.

Of course, other combinations of the respective aspects are possible.

It is clear that the invention also relates to devices for realizing the aforementioned methods, whereby these devices consist of one or more textile machines, more particularly weaving machines and/or parts of the weaving machine and/or peripherical devices therefore, whereby this device is provided with means for realizing the methods concerned. These means consist of all afore-mentioned accessories, such as said identification elements and the pertaining transmitting and receiving means, said machine terminals and the necessary electronic circuits for visualizing the discussed images and the like, said couplings to a server, said parts which are provided with identification elements, and so on.

DESCRIPTION OF THE DRAWINGS

With the intention of better showing the characteristics of the invention, hereafter, as an example without any limitative character, several preferred forms of embodiment are described, with reference to the accompanying drawings, wherein.

DETAILED DESCRIPTION

Figure 1:
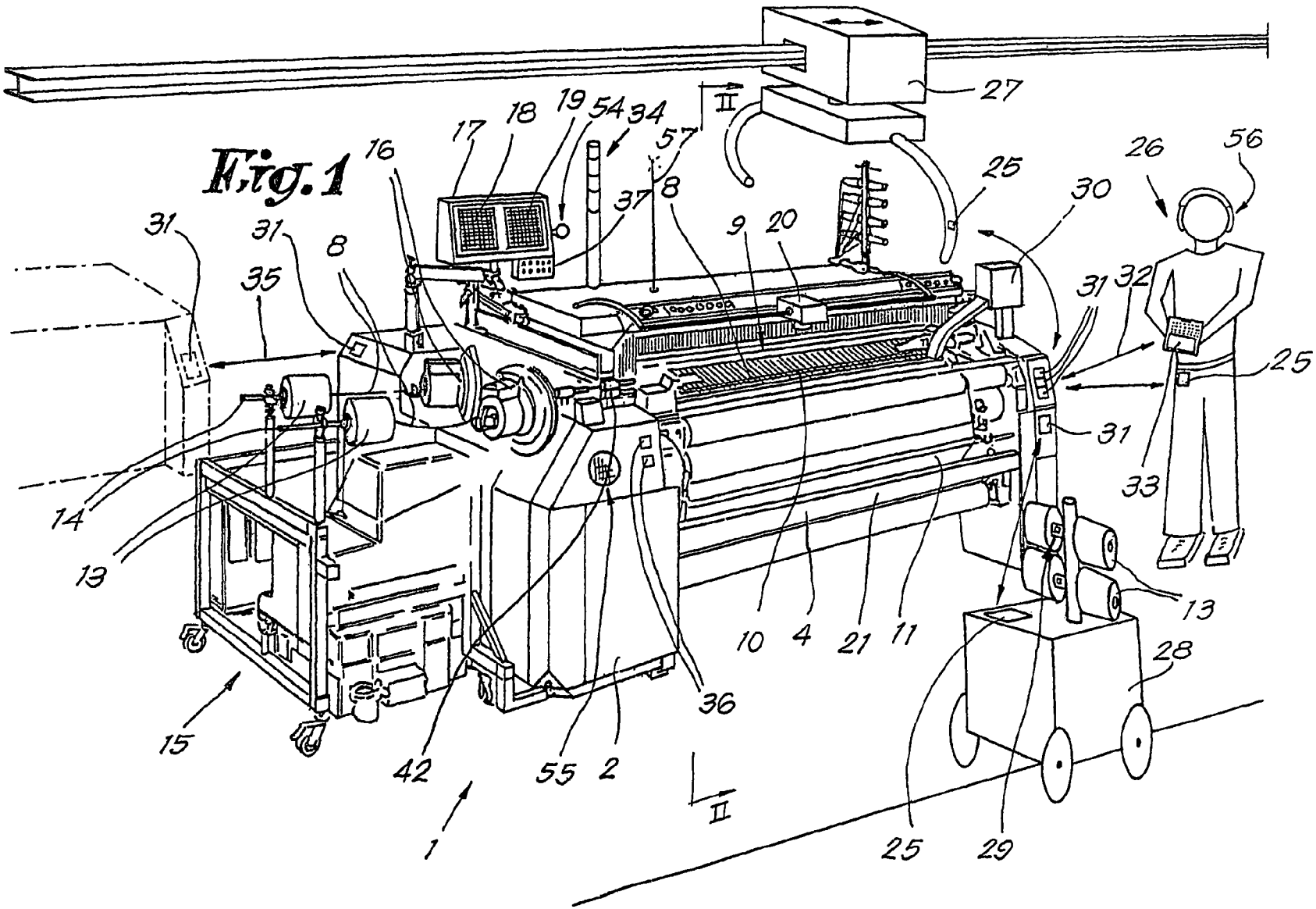
FIG. 1 schematically represents a weaving machine which is equipped with means for realizing a number of said aspects of the invention.
Figure 2:
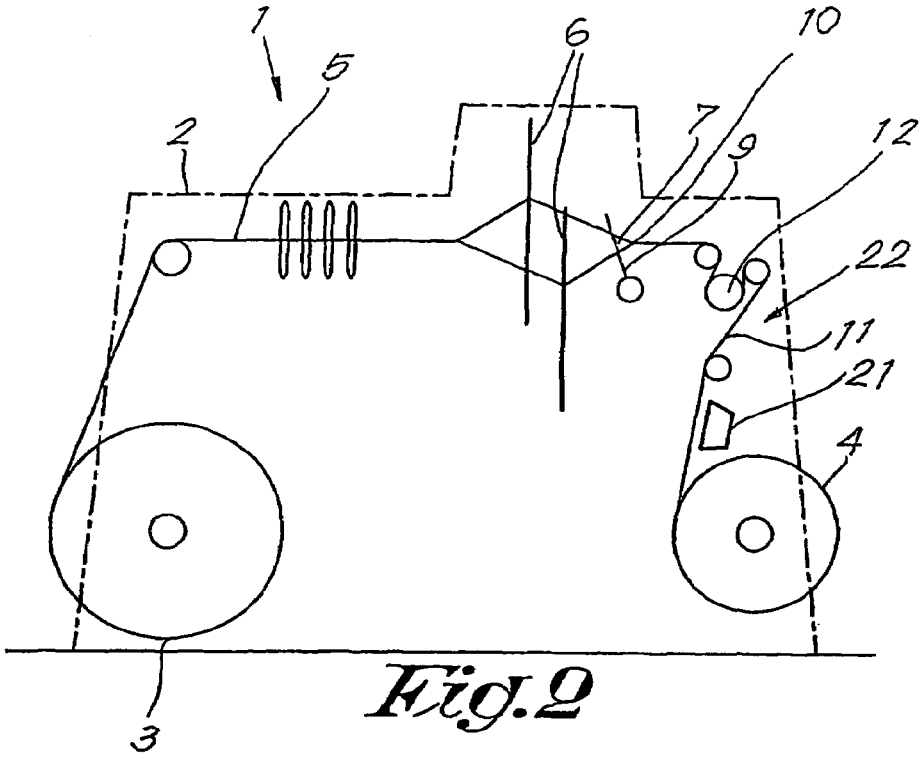
FIG. 2 schematically represents a cross-section according to line II-II in FIG. 1.

In FIGS. 1 and 2, a weaving machine 1 is represented which, as known, includes a chassis 2 in which a warp beam 3 and a cloth roll 4 can be provided. In a known manner, thereby warp threads 5 are wound off the warp beam 3 and fed through weaving frames 6, such that a shed 7 is formed, in which weft threads 8 can be beaten, by means of the reed 9, against the beating line 10 of the already formed cloth or fabric 11. The formed cloth 11 is transported off by means of a number of rolls, amongst which the so-called sand roll 12, in order to be wound onto the cloth roll 4.

The weft threads 8 are supplied in a known manner from bobbins 13, which are mounted on pins 14 of a bobbin rack 15, by the intermediary of prewinders 16.

The weaving machine 1 is provided with a machine terminal 17.

According to said first aspect of the invention, as explained in the a foregoing, different visualizations are realized on the machine terminal 17, which comprises, amongst others, a colour screen or display and a terminal, whereby one of the most important visualizations consists in that on this screen, images of the fabric are shown, in this case, a first image 18 of the fabric such as it theoretically should be, and a second image 19 which is an illustration of the really woven fabric or cloth 11. The image 18 is supplied in the manner as described in the a foregoing, whereas the image 19 is the result of a recording, either by means of a camera 20 which, for example, can be moved to and fro alongside the fabric 11, or by means of a so-called on-loom inspection system 21 which is installed in the weaving machine.

It is clear that as such, also other visualizations according to the invention are possible, more particularly such as described in the introduction.

According to the second aspect of the invention, visualizations of detections which are performed on the on-loom inspection system 21 are shown directly on the machine terminal 17.

In accordance with the third aspect of the invention, said on-loom inspection system 21 is mounted in the cloth wind-up zone or the zone 22 below the sand roll 12 of the weaving machine 1, which results in the advantages mentioned in the introduction.

Figure 3:
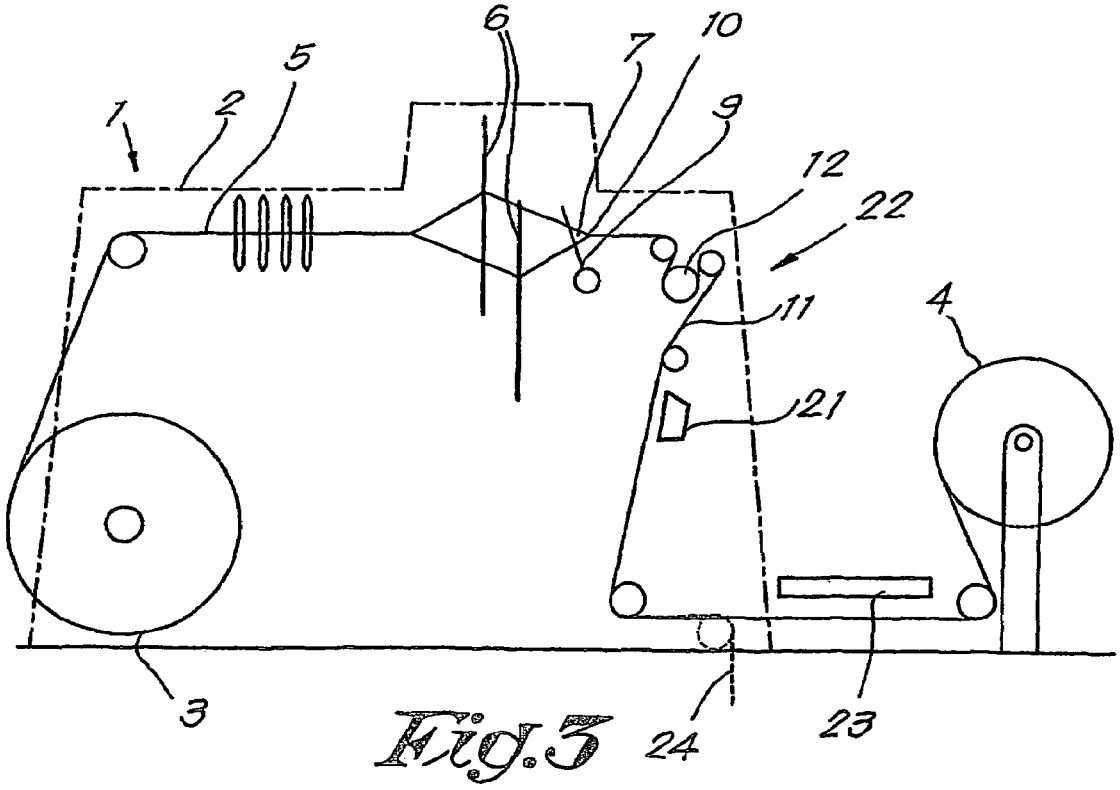
FIG. 3 represents a variant of FIG. 2.

FIG. 3 schematically represents a variant of this third aspect, whereby the cloth or fabric 11 is wound onto a cloth roll 4 which is arranged separately from the actual weaving machine 1, with therein between, for example, a walking platform 23. In accordance with the third aspect, the on-loom inspection system 21 also is situated in the zone where the fabric 11 is transported off.

As indicated by dashed-line 24 in FIG. 3, according to a variant the fabric 11 also can be directed to another location, for example, to a lower floor, whereas the third aspect of the invention still remains valid.

According to the fourth aspect of the invention, use is made of low-cost identification elements 25 which, as explained in the introduction, allow to realize various identifications, verifications and the like. In the example of FIG. 1, schematically a number of these identification elements 25 are represented, to wit at an operator 26, at an overhead cleaning device 27 which can move along different weaving machines 1, at a, for example, electromagnetically guided carriage 28 for supplying accessories, such as the aforementioned bobbins 13, at the spools 29 of the bobbins 13, and so on. As a result thereof, identifications, verifications and control operations are made possible, as described in the introduction.

FIG. 1 schematically also represents how a weaving machine 1 can be provided with an apparatus for automatically providing identification elements 25 on the formed fabric or cloth 11. It is obvious that to this aim, different embodiments can be applied by the person skilled in the art, such as, for example, adhering devices for automatically adhering identification elements which here are not described in detail The use of the apparatus 30 and the purpose of the application of such identification elements 25 by means of this apparatus 30 are described in detail in the introduction.

The identification elements 25 may cooperate, as indicated schematically, with one or more transmitting and receiving means 31 which are provided at the weaving machine 1 and which are indicated schematically by reference 31.

FIG. 1. illustrates, also in a schematic manner, the fifth aspect of the invention, to wit that a communication 32 is possible between the weaving machine 1, more particularly the control means of the weaving machines 1 which are connected to transmitting and receiving means 31, and a portable computer unit 33, for example, a PDA, operated by the operator 26 or such.

The signalization described in the a foregoing in respect to the sixth aspect of the invention, may take place, as aforementioned, by means of the indication lamps 34 usually present at the weaving machine 1. According to a variant, the indication lamps 34 can be replaced by a so-called message display, on which information can be read from a distance.

Further, FIG. 1 schematically represents that also a mutual communication 35 between different textile machines, in this case, weaving machines 1, is possible, for example, in order to realize the seventh aspect of the invention.

The aforementioned eighth aspect, described in detail in the a foregoing, also is realized by means of the represented machine terminal 17.

By means of the aforementioned communication 35, which either can be realized wireless or not, whether by means of a not-represented server or not, also the possible ninth aspect is realized, to wit the adaptation of machine parameters by means of communication between different machines, based on distributed intelligence. Apart from a display or screen, the machine terminal 17 also may comprise a keyboard 37, however, preference is given to a display or screen in which the keyboard or push-buttons are integrated, i.e. a so-called "touch display". This is particularly advantageous in dusty weaving mills.

For the eleventh aspect, use can be made of the fixedly mounted camera 20, however, according to a not shown variant, also other photographic and camera devices can be applied.

The twelfth aspect is realized by means of sensors 36 which can be mounted on the weaving machine 1 itself.

Figure 4:
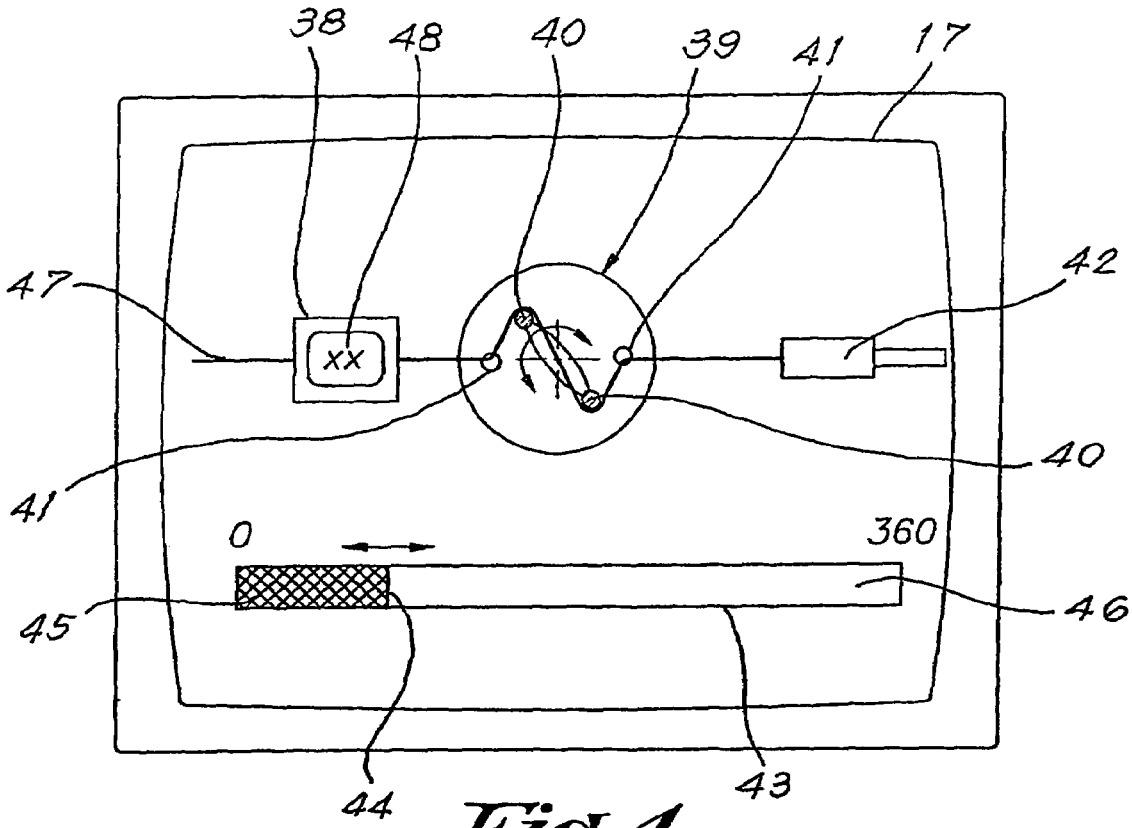
FIGS. 4 and 5 schematically represent a machine screen for two particular applications of the invention.

In FIG. 4, a part of a weft insertion channel is shown on the machine screen, which channel comprises a weft tension measuring device 38, a thread brake 39 with two movable thread brake elements 40, such as guide pins, and two fixed thread guide elements 41, and a main nozzle 42. Further, on this screen, a progress bar 43 is shown that can represent the position of the main shaft of the loom. In this progress bar 43, the position of the main shaft of the loom is represented by the position of the borderline 44 between a filled-up section 45 and an empty section 46. Furthermore, the weft thread 47 is shown. If the position of the thread brake elements 40 is determined as a function of the position of the main shaft of the loom, for example by using the position sensor of the motor for controlling the thread brake elements 40, the position of said thread brake elements 40 can easily be determined as a function of the main shaft of the loon. Furthermore, the maximum tension that the weft thread can stand without a real danger of breaking is, for example, entered into the machine terminal or the central server.

According to an example of the aforementioned thirteenth aspect of the invention, the screen 17 shows, for each position of the main shaft, the progress bar 43, as well as the thread brake elements 40, in their corresponding positions. Furthermore, on the screen 17, the weft thread is coloured, for example, blue if its tension is less than 20% of its entered maximum tension, green if its tension is between 20% and 50% of this maximum tension, orange if its tension is between 50% and 80% of this maximum tension, and red if its tension is between 80% and 100% of its maximum tension. Hereby, the colour will become darker red or will flash up the more the measured tension approaches this maximum tension. This enables a person to control the tension of the weft thread, in particular to control in what positions of the main shaft the tension is the highest and whether the tension approaches the maximum tension of the thread. In this way, the person can check very easily in which positions of the main shaft and of the thread brake elements there is a considerable risk of a thread break by checking whether the weft thread 47 shown on the screen 17 becomes darker red or is flashing up. According to a variant, a percentage of the maximum tension can also be shown, for example, in a window 48 that is present in the rectangle of the represented measuring device 38. According to another variant, the real value of the tension in the weft thread can be shown in this window 48, although this value is less applicable for the operator. According to still another variant, instead of entering the maximum tension that the weft thread can stand, the weaving machine determines the maximum tension of the weft thread during insertion and uses this value for determining in which colour the weft thread has to be represented on the screen, in a similar way as mentioned above. In this way, it is possible to show the tension of an inserted weft thread in the shed in slow motion on the screen, as a function of the angular position of the running main shaft According to a further variant, in rapier looms, instead of the position of the main shaft, the position of the rapier that is related to the position of the main shaft, can be shown on the screen in a way similar to the main shaft This means that in this embodiment, the borderline 44 of the progress bar 43 represents the position of the rapier in the shed instead of the angular position of the main shaft.

Figure 5:
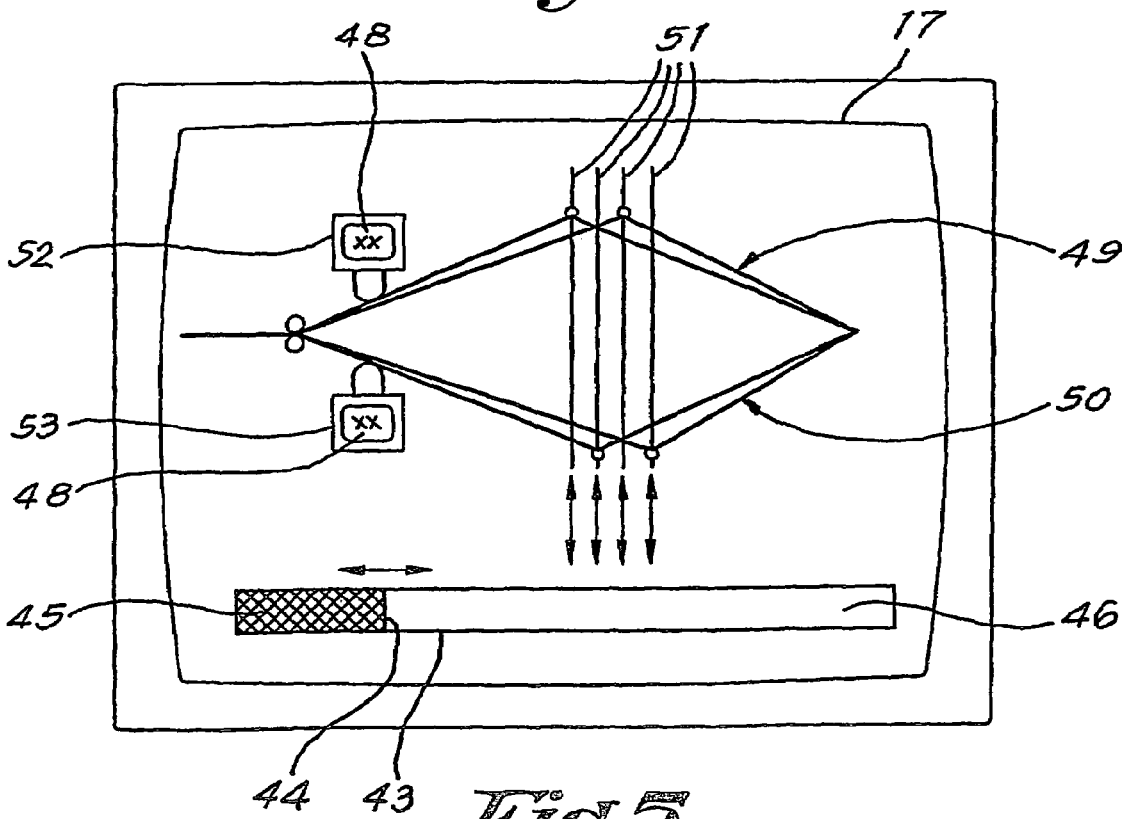

In FIG. 5, the part of a weaving machine that is shown on the screen 17 of the weaving machine comprises an upper warp 49 and a lower warp 50 that are formed by means of shed-forming means 51. Further, a tension-measuring device 52 for measuring the tension in the upper warp 49 and a tension-measuring device 53 for measuring the tension in the lower warp 50 are shown on the screen 17. Further, on this screen 17 a progress bar 43, similar to the one shown in FIG. 4, is shown.

According to an example of the above-mentioned fourteenth aspect, the screen 17 shows, for each position of the main shaft, the progress bar 43, as well as the shed-forming means 51 in their corresponding positions. Furthermore, the warp threads of the upper warp 49 and the warp threads of the lower warp 50 are coloured, similarly to the weft thread as described for FIG. 4, and as a function of the maximum allowed tension in the warp threads used, and this depending on their tension that is measured respectively by the tension-measuring devices 52 or 53. This enables, for example, the person controlling the tension in the warp, to observe whether the warp thread tension becomes too high and in which positions of the main shaft this does occur. This allows this person to set the parameters of the shed-forming means such that this tension does not become too high so as to avoid warp thread breaks. Similar as described in respect to FIG. 4, the percentage of the maximum tension can be shown in the respective window 48 of the rectangle that is part of the shown measuring device 52 or 53. According to another variant, the real-value of the tension in the warp threads can be shown in this window. According to still another variant, instead of entering the maximum tension that the warp thread can stand, the weaving machine determines the maximum tension of the warp thread during weaving and uses this value for determining the colour of the weft thread in a similar way as mentioned above.

It is obvious that different variants and additions to the a foregoing are possible.

Thus, it is, for example, possible for the invention to visualize an instruction manual for operating the weaving machine 1 by means of the screen and/or to render it accessible by means of voice technology. This is not only important for being able to operate the weaving machine 1 during weaving, but is of particular importance for maintaining, repairing or replacing a certain part. Hereby, the procedure to be followed, for example, is represented on the screen. Hereby, not only images are important, but, for example, also a film can be shown on the screen, as well as photographs.

Showing a film, photographs or such, is not limited to instruction manuals, but can be applied in general, for example, within the scope of said first aspect, whereby the image concerned, images concerned, respectively, then also may comprise film images.

Apart from a keyboard 37 or a "touch display", as already mentioned in the a foregoing, also a microphone 54 can be provided at the textile production machine, in this case, the weaving machine 1, such that the weaver or operator 26 can communicate with the respective machine. In an analogous manner, this machine may comprise a loudspeaker 55 with which a communication with the operator 26 is possible. This latter can also be obtained by means of a transmitter of the weaving machine 1 which can communicate with the operator 26 by means of headphones 56 or a hearing apparatus.

In a particularly preferred application, the spoken communication can be applied in combination with the instruction manual accessible by means of the weaving machine. In this manner, the operator or somebody who performs repairs at the weaving machine, for example, may be informed step by step which steps have to be performed.

Considering the performance of a number of said aspects, the weaving machine 1 or such also can be provided with one or more suitable antennas 57.

The present invention is in no way limited to the forms of embodiment described as an example and represented in the figures, on the contrary may such methods and devices for optimizing textile production processes be realized according to different variants, without leaving the scope of the invention.

The invention claimed is:

1. A method for optimizing a textile weaving process carried out on an automated weaving machine wherein the weaving machine includes a sand roll and an on-loom fabric inspection system that cooperates in the weaving process comprising the steps:

providing a visual image display screen associated with the weaving machine;

generating and displaying on the screen at least one visual image representative of at least one selected characteristic of the fabric or fabric determining elements constituting the textile woven or intended to be woven on the weaving machine, said visual image comprising an image of a fabric woven or intended to be woven on the weaving machine; and locating a fabric observation element of the on-loom fabric inspection system below the sand roll.

2. A method for optimizing a textile weaving process carried out on an automated weaving machine comprising the steps:

providing a visual image display screen associated with the weaving machine;

generating and displaying on the screen at least one visual image representative of at least one selected characteristic of the fabric or fabric determining elements constituting the textile woven or intended to be woven on the weaving machine, displaying an image of an inquiry requesting confirmation of whether the weaving process is to continue upon start-up of the weaving machine, and stopping the weaving machine if confirmation that the weaving process is to continue is not communicated to a controller of the weaving machine within a prescribed time limit.

3. A method for optimizing a textile weaving process carried out on an automated weaving machine, wherein the weaving machine includes an on-loom fabric inspection system that cooperates in the weaving process, comprising:

displaying on a visual image display screen associated with the weaving machine at least a representation of one or more conditions detected by said fabric inspection system;

upon detection of a weaving fault by the inspection system, visually displaying such weaving fault as an image on the display screen, and generating and assigning a global value factor for a fabric actually woven on the weaving machine, said global value factor being calculated by allocating, processing and storing a cipher value in response to a display of a weaving fault detected by the inspection system in the fabric actually woven.

4. A method for optimizing a textile weaving process carried out on an automated weaving machine having a sand roll and an on-loom fabric inspection system that cooperates in the weaving process, comprising the steps:

providing a visual image display screen associated with the weaving machine;

generating and displaying on the screen at least one visual image representative of at least one selected characteristic of the fabric or fabric determining elements constituting the textile woven or intended to be woven on the weaving machine; and locating a fabric observation element of the on-loom fabric inspection system below the sand roll.

5. A method for optimizing a textile weaving process carried out on an automated weaving machine having a sand roll, wherein the weaving machine includes an on-loom fabric inspection system that cooperates in the weaving process, comprising displaying on a visual image display screen associated with the weaving machine at least a representation of one or more conditions detected by said fabric inspection system; and locating a fabric observation element of the on loom fabric inspection system below the sand roll.

6. A method for optimizing a textile weaving process carried out on an automated weaving machine comprising the steps:

providing a visual image display screen associated with the weaving machine;

generating and displaying on the screen at least one visual image representative of at least one selected characteristic of the fabric or fabric determining elements constituting the textile woven or intended to be woven on the weaving machine, said visual image comprising an image of a fabric woven or intended to be woven on the weaving machine; and stopping the weaving machine if confirmation that the weaving process is to continue is not communicated to a controller of the weaving machine within a prescribed time limit.

7. A method for optimizing a textile weaving process carried out on an automated weaving machine, wherein the weaving machine includes an on-loom fabric inspection system that cooperates in the weaving process, including displaying on a visual image display screen associated with the weaving machine at least a representation of one or more conditions detected by said fabric inspection system and an image of a fabric woven or to be woven on the weaving machine;

wherein upon detection of a weaving fault by the inspection system, such weaving fault is visually displayed as an image on the display screen; and including generating and assigning a global value factor for a fabric actually woven on the weaving machine, said global value factor being calculated by allocating, processing and storing a cipher value in response to a display of a weaving fault detected by the inspection system in the fabric actually woven.

8. A method for optimizing a textile weaving process carried out on an automated weaving machine, wherein the weaving machine includes a sand roll and an on-loom fabric inspection system that cooperates in the weaving process, including displaying on a visual image display screen associated with the weaving machine at least a representation of one or more conditions detected by said fabric inspection system and an image of a fabric woven or to be woven on the weaving machine; and locating a fabric observation element of the on loom fabric inspection system below the sand roll.

9. A method for optimizing a textile weaving process carried out on an automated weaving machine comprising the steps:

providing a visual image display screen associated with the weaving machine;

generating and displaying on the screen at least one visual image representative of at least one selected characteristic of the fabric or fabric determining elements constituting the textile intended to be woven on the weaving machine, said visual image comprising an image of a fabric intended to be woven on the weaving machine;

said visual image further comprising an image of a fabric woven on the weaving machine.

10. A method for optimizing a textile weaving process carried out on an automated weaving machine, wherein the weaving machine includes an on-loom fabric inspection system that cooperates in the weaving process, including displaying on a visual image display screen associated with the weaving machine at least a representation of one or more conditions detected by said fabric inspection system and an image of a fabric intended to be woven on the weaving machine; and further including displaying on said visual image display screen associated with the weaving machine an image of a fabric woven on the weaving machine.

11. A method for optimizing a textile weaving process carried out on an automated weaving machine, wherein the weaving machine includes a sand roll and an on-loom inspection system that cooperates in the weaving process, comprising displaying on a visual image display screen associated with the weaving machine at least a representation of a fabric woven on the weaving machine; and locating a fabric observation element of the on-loom fabric inspection system below the sand roll.

12. The method according to claim 1, wherein said weaving machine includes a cloth roll within a chassis of the weaving machine beyond the sand roll relative to a direction of travel of fabric formed on the weaving machine, and including carrying out inspection of the fabric by said inspection system between the sand roll and the cloth roll.

13. The method according to claim 1, including directing the formed fabric beyond the sand roll downwardly to another location in the direction of fabric travel, and carrying out inspection of the fabric by said inspection system between the sand roll and the location to which the fabric travels.

14. The method according to claim 8, wherein said weaving machine includes a cloth roll within a chassis of the weaving machine beyond the sand roll relative to a direction of travel of fabric formed on the weaving machine, and including carrying out inspection of the fabric by said inspection system between the sand roll and the cloth roll.

15. The method according to claim 8, including directing the formed fabric beyond the sand roll downwardly to another location in the direction of fabric travel, and carrying out inspection of the fabric by said inspection system between the sand roll and the location to which the fabric travels.

16. The method according to claim 4, wherein said weaving machine includes a cloth roll within a chassis of the weaving machine beyond the sand roll relative to a direction of travel of fabric formed on the weaving machine, and comprising the step of carrying out inspection of the fabric by said inspection system between the sand roll and the cloth roll.

17. The method according to claim 4, including directing the formed fabric beyond the sand roll downwardly to another location in the direction of fabric travel, and carrying out inspection of the fabric by said inspection system between the sand roll and the location to which the fabric travels.

18. The method according to claim 5, wherein said weaving machine includes a cloth roll within a chassis of the weaving machine beyond the sand roll relative to a direction of travel of fabric formed on the weaving machine, and including carrying out inspection of the fabric by said inspection system between the sand roll and the cloth roll.

19. The method according to claim 5, including directing the formed fabric beyond the sand roll downwardly to another location in the direction of fabric travel, and carrying out inspection of the fabric by said inspection system between the sand roll and the location to which the fabric travels.

20. The method according to claim 11, wherein said weaving machine includes a cloth roll within a chassis of the weaving machine beyond the sand roll relative to a direction of travel of fabric formed on the waving machine, and including carrying out inspection of the fabric by said inspection system between the sand roll and the cloth roll.

21. The method according to claim 11,including directing the formed fabric beyond the sand roll downwardly to another location in the direction of fabric travel, and carrying out inspection of the fabric by said inspection system between the sand roll and the location to which the fabric travels.

* * * * *